United States Patent [19]

Jencks et al.

[11] 4,107,497

[45] Aug. 15, 1978

[54] ARC CHUTE ASSEMBLY

[75] Inventors: Charles L. Jencks, Avon; Roger N. Castonguay, Bristol, both of Conn.

[73] Assignee: General Electric Company, New York, N.Y.

[21] Appl. No.: 705,651

[22] Filed: Jul. 15, 1976

Related U.S. Application Data

[63] Continuation of Ser. No. 527,302, Nov. 26, 1974, abandoned.

[51] Int. Cl.[2] ..... H01H 33/10

[52] U.S. Cl. ..... 200/144 R

[58] Field of Search ..... 200/144 R, 148 C

[56] References Cited

U.S. PATENT DOCUMENTS

| | | | |
|---|---|---|---|
| 2,942,083 | 6/1960 | Walker et al. | 200/144 R |
| 3,198,915 | 8/1965 | Wortmann | 200/144 R |
| 3,582,966 | 6/1971 | Strobel | 200/144 R |

*Primary Examiner*—Robert S. Macon

*Attorney, Agent, or Firm*—Robert A. Cahill; Walter C. Bernkopf; Frank L. Neuhauser

[57] ABSTRACT

An arc chute for circuit interrupting devices comprises a series of identical arc plates, each having a pair of opposed, laterally extending tangs which fit through slots in insulative sideplates. The tangs are undercut to provide notches in which the sideplates are engaged when the arc plates are bodily shifted to locked positions with the tangs latched in the sideplate slots. An insulative backplate captured in slides in the sideplates engages the arc plates to sustain their locked positions.

2 Claims, 6 Drawing Figures

ARC CHUTE ASSEMBLY

This is a continuation, of application Ser. No. 527,302, filed Nov. 26, 1974 now abandoned.

BACKGROUND OF THE INVENTION

It is currently conventional practice to assemble arc chutes for circuit interrupting devices of relatively high current interrupting capacity by providing the arc plates with lateral tangs which are inserted through slots in insulative sideplates and then staked over to reliably sustain the assembly. A departure from this practice, which to applicants' knowledge never gained significant acceptance in the industry, is disclosed in an early U.S. Pat. No. 2,363,606. In this patent disclosure, staking is eliminated by undercutting the arc plate lateral tangs such that they can latchably engage edge portions of the sideplate slots. However, this latching engagement is not locked or made secure until the arc chute is assembled in the case of the circuit interrupting device. Once assembled in the device case, insulative plates, separate from the arc chute assembly, are positioned by the case to prevent movement of the arc plates which would unlatch the tangs from the sideplates. Moreover, the terminations of the tangs are received in vertical grooves in the case sidewalls to further prevent unlatching movements of the arc plates.

The arc chute design disclosed in U.S. Pat. No. 2,363,606 has the distinct drawback in that the arc chute assembly is not securely united prior to insertion into the case of the interrupting device. Since, in practice, arc chutes are typically created as sub-assemblied and stockpiled in anticipation of the final assembly of the interrupting devices, the arc chutes of the patented design can become disassembled during handling and stockpiling. To then have to undertake even a minor degree of re-assembly of the arc chutes at the time of final assembly of the interrupting devices detracts from the efficiency of the overall manufacturing operation.

It is accordingly an object of the present invention to provide an arc chute assembly for circuit interrupting devices.

An additional object is to provide an arc chute assembly of the above character in which the parts thereof are uniquely configured to be assembled in an interlocking fashion.

Still another object of the present invention is to provide an arc chute of the above character wherein the parts thereof are securely maintained in assembled relation without resort to the conventional practice of staking.

A further object is to provide an arc chute of the above character which is simple in design and readily assembled, thus being being inexpensive to manufacture.

Other objects of the invention will be made apparent from the following detailed description and appended claims.

SUMMARY OF THE INVENTION

In accordance with the present invention, there is provided an arc chute assembly for circuit interrupting devices, wherein the parts thereof are positively and reliable maintained in assembled relation without staking. The elimination of staking obviates the need for the fixturing requiring in a staking operation. Also, the occasional destruction of arc chute parts during a staking operation, particularly the insulative sideplates to which the arc plates are normally staked, is avoided. Thus, simpler and faster assembly of arc chutes is afforded by the instant invention.

More specifically, the arc plates are provided, in accordance with the present invention, with laterally extending tangs which are inserted through slots in insulative sideplates. The tangs are undercut to provide individual notches in which the portions of the sideplates beyond the ends of their slots are latchably engaged when the arc plates are bodily shifted to locked positions. These locked positions of the arc plates are sustained by an insulative backplate having lateral tangs which are inserted in additional slots in the sideplates. This backplate bars movements of the individual arc plates which would unlatch the arc plate tangs from the sideplate slots. As a consequence, the assemblage of the arc chute parts is positively preserved and is not disturbed by handling prior to and incident to final assembly of the arc chutes in a circuit interrupting device.

The invention accordingly comprises the features of construction, combination of elements and arrangement of parts which will be exemplified in the construction hereinafter set forth, and the scope of the invention will be indicated in the claims.

For a better understanding of the nature and objects of the invention, reference should be had to the following detailed description taken in connection with the accompanying drawings, in which.

Like reference numerals refer to corresponding parts throughout the several views of the drawings.

DETAILED DESCRIPTION

Figure 3:
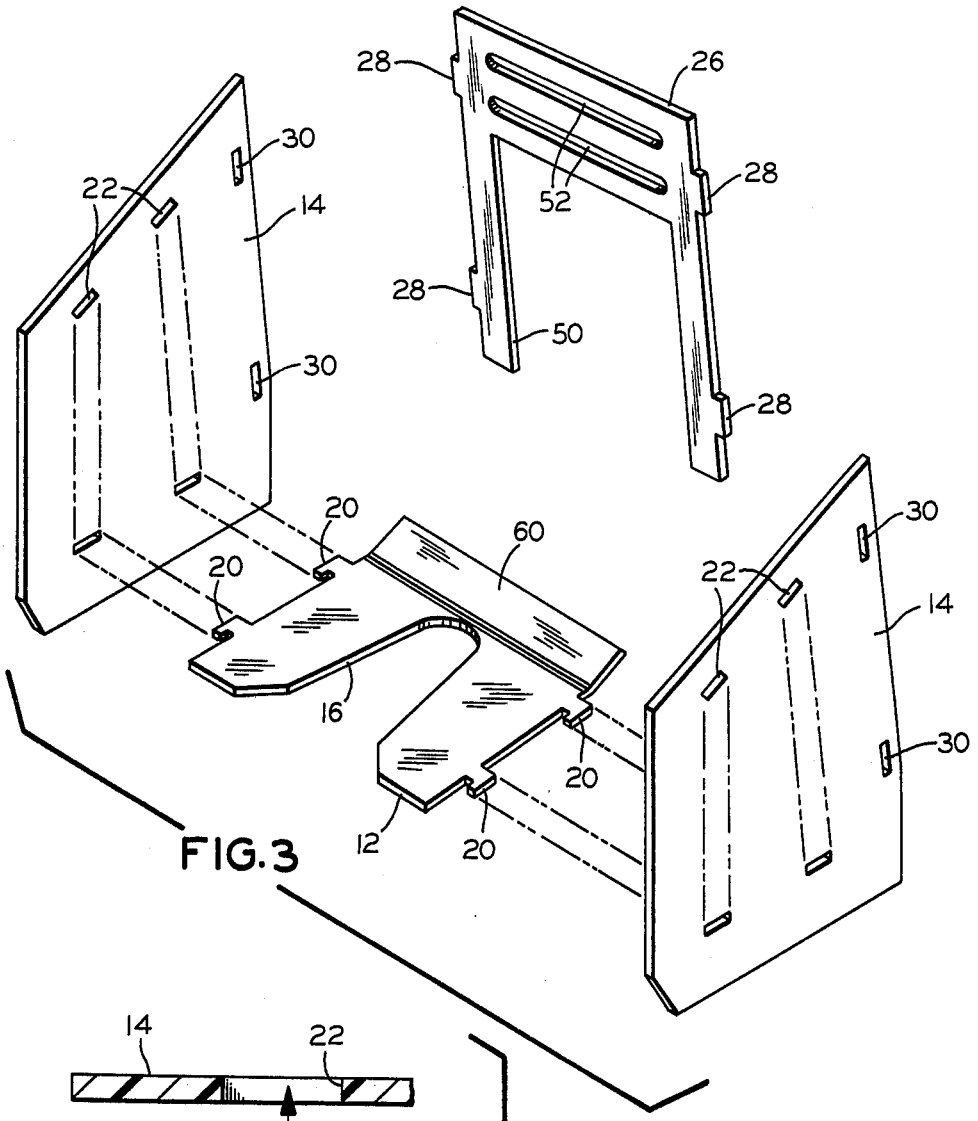
FIG. 3 is an exploded perspective view of the arc chute assembly of FIG. 1, which, for the sake of simplicity, depicts only one of the plural arc plates.
Figure 4A:
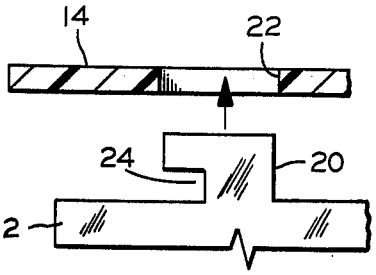
FIGS. 4A and 4B are fragmentary sectional views illustrating the manner of assembly of the arc plates in the arc chute assembly of FIG. 1.
Figure 4B:
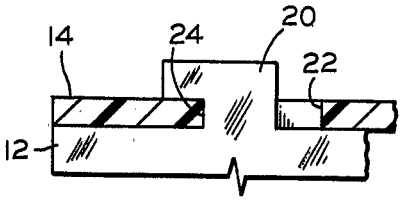
Figure 5:
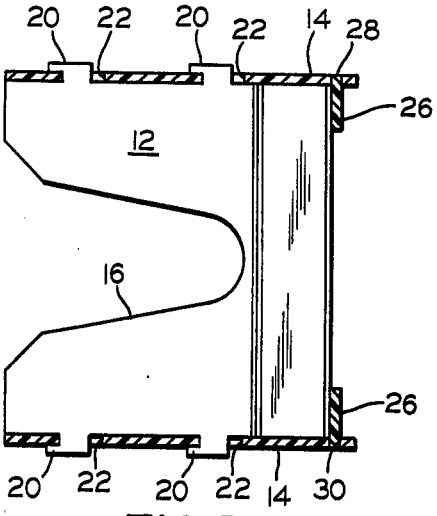
FIG. 5 is a sectional view taken along line 5—5 of FIG. 2.

The construction of the arc chute assembly of the present invention, generally indicated at 10 in the drawings, is perhaps best appreciated from the exploded perspective view of FIG. 3. The arc chute assembly includes a plurality of arc plates 12, of which only one is shown for simplicity's sake. The arc plates are mounted in stacked array by insulative sideplates 14. Each of the arc plates is formed with a deep, longitudinally extending notch, indicated at 16, to provide clearance for the movement of a movable arcing contact (not shown) toward and away from closure with a stationary arcing contact 18 seen in FIG. 1. In accordance with a signal feature of the invention, each arc plate is provided with opposed pairs of laterally extending tangs 20 which are received through elongated slots 22 formed in insulative sideplates 14. As best seen in FIGS. 4A, 4B and 5, each tang is undercut to provide a notch 24. The major width of tangs 20 is slightly less than the length of the sideplate slots 22, such that the tangs can be readily received therethrough. Once the tangs are inserted through the slots 22 in one or both sideplates, the arc plates are moved individually or en masse in the direction of their notched side edge (or the sideplates 14 moved in the opposite direction) to latchably engage the sideplates in the tang notches 24. To sustain these locked positions of the tangs latched in the sideplate slots, an insulative backplate 26 is provided with opposed pairs of laterally extending tangs 28 which are received in vertically elongated slots 30 formed in the sideplates 24. The sideplates are essentially rigid, but are formed of a material having sufficient flexibility to permit the rear portions of the sideplates to be separated somewhat further apart to permit the backplate to be positioned therebetween with its tangs 28 received in the sideplate slots 30 in essentially snap-fit fashion. The rear edges of the arc plates abut backplate 26 to thereby inhibit the relative movements of the arc plates and sideplates tending to unlatch the tangs 20 from the sideplate slots 22.

Figure 1:
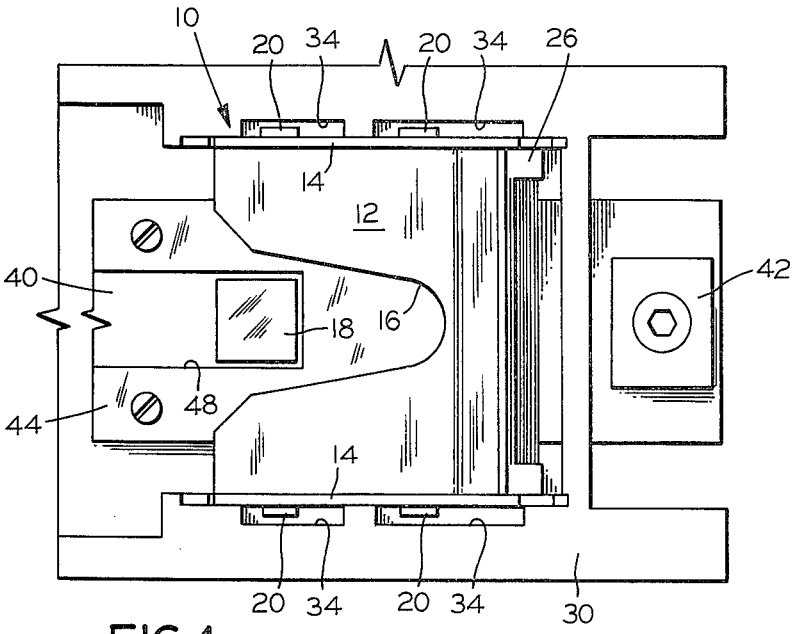
FIG. 1 is a fragmentary top plan view of a circuit interrupting device incorporating an arc chute assembly of the present invention.
Figure 2:
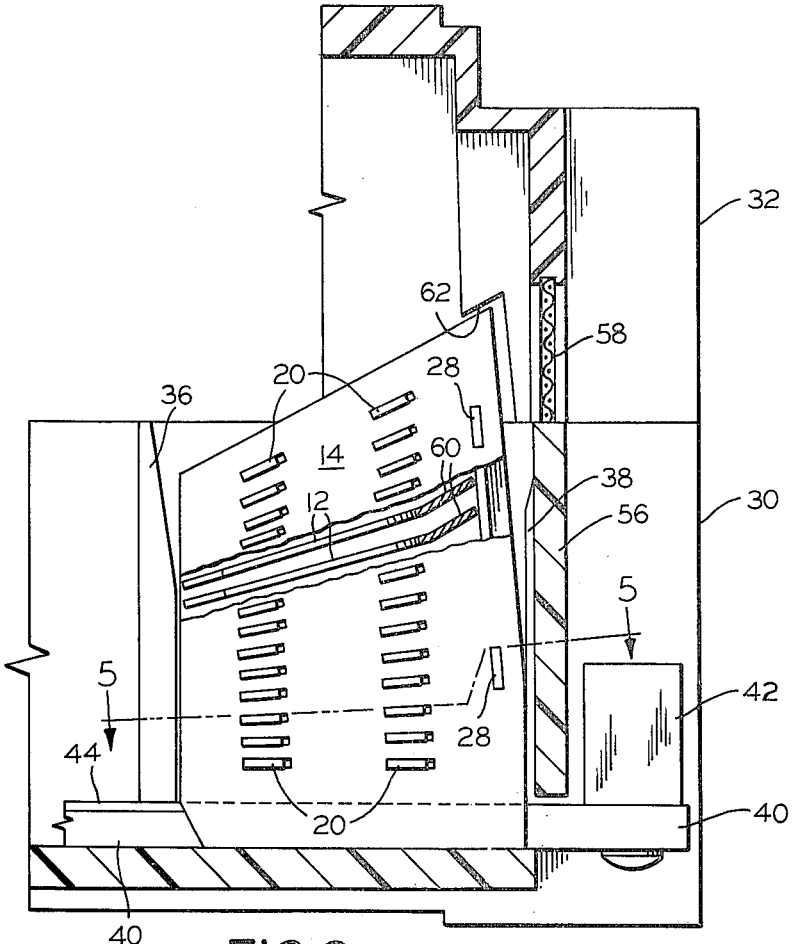
FIG. 2 is a side elevational view, partially broken away, of the arc chute assembly of FIG. 1, together with portions of the circuit interrupting device case.

Turning now to FIGS. 1 and 2, the arc chute assembly 10 of the present invention is incorporated in each pole chamber of a molded case circuit interrupting device, e.g., an automatic electric circuit breaker, wherein the case consists of a base 30 and a cover 32. As seen in FIG. 1, the base 30 is provided with vertically extending grooves 34 in the pole chamber sidewalls to provide clearance for the arc plate tangs 20 extending beyond the sideplates 14. Forward locating ribs 36 and rearward locating ribs 38 determine the assembled position of the arc chute assembly 10 in the circuit breaker case. The upper portion of forward ribs 36 is angled forwardly to facilitate assembly. The arc chute assembly is supported in its operative position on the bottom edges of the sideplates in overlying relation to a terminal strap 40 to which arcing contact 18 is welded. Terminal strap extends exteriorly of the circuit breaker case where external circuit connection is made using a lug 42. Secured against the upper surface of terminal strap 40 is arc runner 44. The arc runner, as seen in FIG. 1, is notched, as indicated at 48 in order to expose the arcing contact 18.

Returning to FIG. 3, the backplate 26 is notched, as indicated at 50, and is further formed with horizontally extending slots 52 so that the arc gases are free to pass beyond the arc chute assembly and rise upwardly along the backwall 56 of the base 30 to a screened vent opening 58 formed in the cover 32. To assist in directing the arc gases upward toward this vent opening, the arc plates are mounted by the sideplates in progressively increasing upward angles, as best seen in FIG. 2. In addition, the trailing edge portion of each arc plate is also angled upwardly, as indicated at 60 in FIGS. 2 and 3. To hold the arc chute assembly 10 in position within the circuit breaker case, side flanges of the cover 32 are notched, as indicated at 62, to receive the upper back corners of the sideplates, when the cover is in place. Thus, the cover holds the arc chute assembly 10 down in its operative position during shipment and use.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. An arc chute assembly for circuit interrupting devices, said assembly comprising, in combination:

A. a plurality of arc plates each having front, back and side edges;

B. a pair of spaced latching tangs extending laterally from each side edge of each arc plate, each said tang being undercut to provide a notch;

C. a pair of opposed, insulative sideplates mounting said arc plates, said sideplates including means forming elongated slots through which said arc plate tangs extend, 1. said arc plates being shifted to locked positions with the edge portions of said sideplates at one end of said slots engaged in said notches;

D. a separate backplate detachably mounted by said sideplates in engaging relation with the back edges of said arc plates to sustain the locked positions thereof.

2. The arc chute assembly defined in claim 1, wherein said backplate includes opposed tangs and said sideplates include means forming additional slots, said backplate tangs lodged in said additional slots to capture said backplate between said sideplates.

* * * * *